US011123854B2

(12) United States Patent
Manschitz et al.

(10) Patent No.: US 11,123,854 B2
(45) Date of Patent: Sep. 21, 2021

(54) HANDHELD POWER TOOL AND CONTROL METHOD

(71) Applicant: Hilti Aktiengesellschaft, Schaan (LI)

(72) Inventors: Erwin Manschitz, Germering (DE); Walter Wissmach, Munich (DE)

(73) Assignee: Hilti Aktiengesellschaft, Schaan (LI)

( * ) Notice: Subject to any disclaimer, the term of this patent is extended or adjusted under 35 U.S.C. 154(b) by 164 days.

(21) Appl. No.: 16/517,317

(22) Filed: Jul. 19, 2019

(65) Prior Publication Data

US 2019/0337137 A1 Nov. 7, 2019

Related U.S. Application Data

(62) Division of application No. 15/321,982, filed as application No. PCT/EP2015/064353 on Jun. 25, 2015, now Pat. No. 10,751,866.

(30) Foreign Application Priority Data

Jun. 27, 2014 (EP) ..... 14174696

(51) Int. Cl.

| | |
|---|---|
| ***B25F 5/00*** | (2006.01) |
| ***B25D 16/00*** | (2006.01) |
| ***B25D 11/12*** | (2006.01) |

(52) U.S. Cl.

CPC ..... *B25D 16/003* (2013.01); *B25D 11/12* (2013.01); *B25F 5/001* (2013.01); *B25D 2211/068* (2013.01); *B25D 2250/205* (2013.01); *B25D 2250/221* (2013.01)

(58) Field of Classification Search

CPC . B25F 5/20; B25F 5/001; B25F 5/006; B25D 16/003

See application file for complete search history.

(56) References Cited

U.S. PATENT DOCUMENTS

| | | | |
|---|---|---|---|
| 5,584,619 | A | 12/1996 | Guzzella |
| 7,011,165 | B2 | 3/2006 | Kristen et al. |
| 7,303,026 | B2 | 12/2007 | Frauhammer et al. |
| 7,467,700 | B2 | 12/2008 | Greese et al. |
| 8,466,641 | B2 | 6/2013 | Kaufmann et al. |
| 9,126,321 | B2 * | 9/2015 | Muller ..... B25D 11/125 |

(Continued)

FOREIGN PATENT DOCUMENTS

| | | |
|---|---|---|
| CN | 1111334 | 11/1995 |
| CN | 1321568 | 11/2001 |

(Continued)

*Primary Examiner* — Chelsea E Stinson
(74) *Attorney, Agent, or Firm* — Davidson, Davidson & Kappel, LLC

(57) ABSTRACT

A handheld power tool has a tool socket (2) to hold a tool (4) along a working axis (11), a motor (5) and a slip clutch (21) having a number of blocking elements. A sensor (27) serves to record a measured signal (28) as the measure of vibrations inside the handheld power tool (1). A band-pass filter (29) has a pass range in which a frequency lies that is equal to the product of the rotational speed of the wheel (22) on the drive side and the number N of blocking elements (24). The measured signal (28) filtered by the band-pass filter (29) is fed to an evaluation unit (30). When the filtered measured signal (28) exceeds a limit value, the evaluation unit (30) reduces the rotational speed of the motor (5).

14 Claims, 1 Drawing Sheet

(56) References Cited

U.S. PATENT DOCUMENTS

| | | | | |
|---|---|---|---|---|
| 9,193,057 | B2 | 11/2015 | Mossnang | |
| 9,505,097 | B2 | 11/2016 | Aoki et al. | |
| 10,183,384 | B2 * | 1/2019 | Takano | B25B 21/02 |
| 10,414,036 | B2 * | 9/2019 | Schaer | B25D 16/00 |
| 2009/0008115 | A1 | 1/2009 | Guo et al. | |
| 2011/0007436 | A1 * | 1/2011 | Single | B25F 5/00 361/23 |
| 2012/0274254 | A1 * | 11/2012 | Muller | B25D 11/125 318/446 |
| 2013/0240230 | A1 * | 9/2013 | Saur | B25B 23/147 173/178 |
| 2014/0196920 | A1 * | 7/2014 | Wirnitzer | B25F 5/00 173/1 |
| 2015/0158170 | A1 | 6/2015 | Nitsche et al. | |
| 2016/0279776 | A1 * | 9/2016 | Wirnitzer | B25D 11/005 |
| 2017/0320205 | A1 | 11/2017 | Schaer et al. | |
| 2018/0043521 | A1 * | 2/2018 | Moessnang | B25F 5/00 |

FOREIGN PATENT DOCUMENTS

| | | | |
|---|---|---|---|
| CN | 1701881 | | 11/2005 |
| CN | 103448035 | | 12/2013 |
| DE | 102009045758 | A1 | 4/2011 |
| DE | 102012208855 | A1 | 11/2013 |
| EP | 1607186 | A1 | 12/2005 |
| EP | 1666754 | | 6/2006 |
| EP | 2410650 | | 1/2012 |
| EP | 2514570 | | 10/2012 |
| EP | 2517839 | | 10/2012 |

* cited by examiner

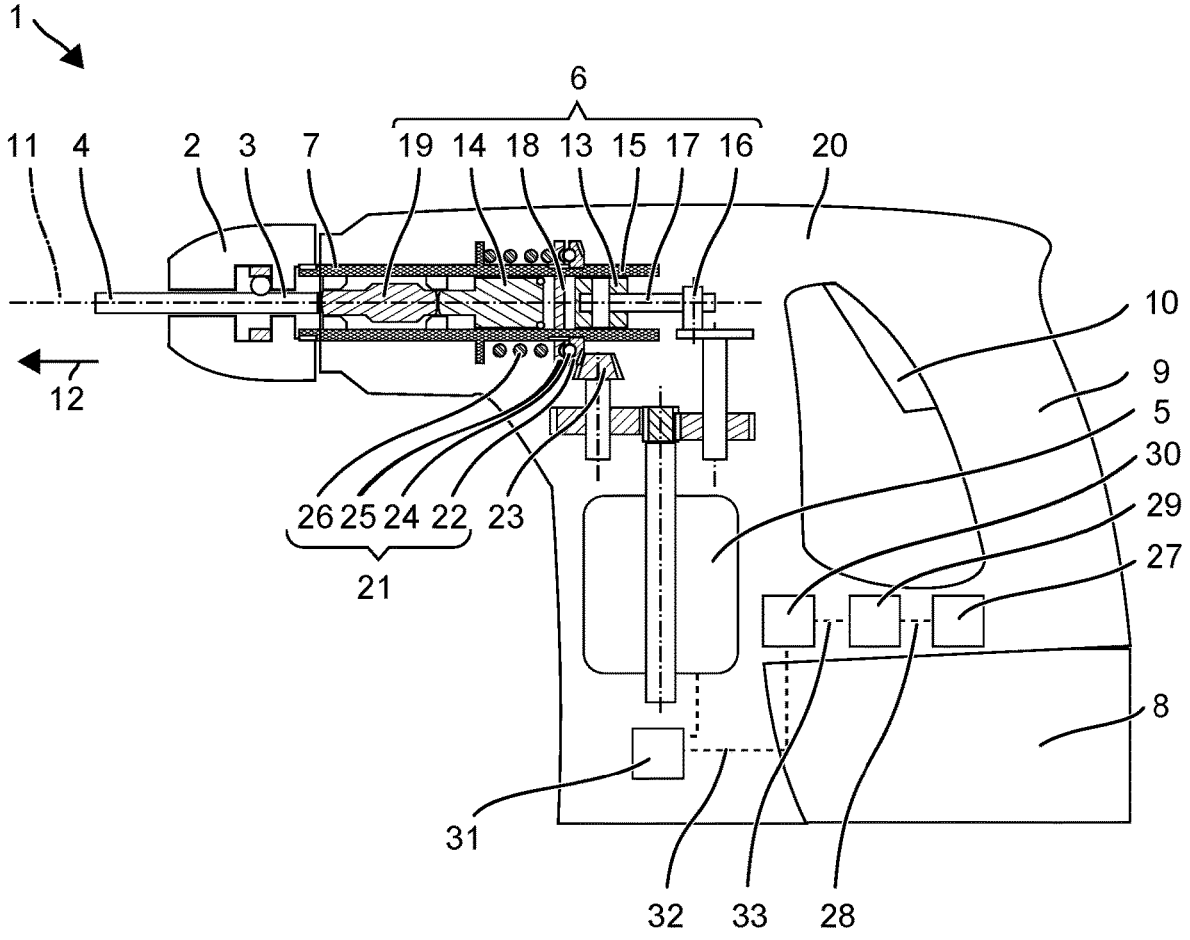
1
6
11
4
2
3
7
19
14
18
13
15
17
16
20
10
9
5
30
29
27
12
26
25
24
22
23
21
8
31
32
33
28

HANDHELD POWER TOOL AND CONTROL METHOD

This is a Divisional of U.S. patent application Ser. No. 15/321,982, filed Dec. 23, 2016 which is a National Phase of International Patent Application PCT/EP2015/064353, filed Jun. 25, 2015 claiming priority to European Patent Application EP 14174696.6, filed Jun. 27, 2014. All of the above referenced applications are hereby incorporated by reference herein.

The present invention relates to a handheld power tool having a slip clutch to interrupt a rotating drive of a tool.

BACKGROUND

U.S. Pat. Publ. No. 2009/0008115, for instance, discloses a hammer drill having a mechanical slip clutch. The slip clutch is triggered when a torque present on the drill bit exceeds a triggering torque. In this process, the slip clutch is subjected to high mechanical loads when the user continuously attempts to proceed with the work.

SUMMARY OF THE INVENTION

A handheld power tool according to the present invention has a tool socket to hold a tool along a working axis, a motor and a slip clutch. The slip clutch has a wheel on the drive side and a wheel on the driven side as well as a number N of blocking elements arranged between the wheel on the drive side and the wheel on the driven side. The blocking elements can be moved relative to one of the wheels. A spring force holds the blocking elements engaged with the one wheel in order to transmit a torque from the wheel on the drive side to the wheel on the driven side. When a torque that exceeds a threshold value is present, the blocking elements, which are held so as to be movable, interrupt the transmission of the torque. A sensor serves to record a measured signal as the measure of accelerations inside the handheld power tool. A band-pass filter has a pass range in which a frequency lies that is equal to the product of the rotational speed of the wheel on the drive side and the number N of blocking elements. The measured signal filtered by the band-pass filter is fed to an evaluation unit. When the filtered measured signal exceeds a limit value, the evaluation unit reduces the rotational speed of the motor.

The control method according to the present invention records a measured signal as the measure of accelerations inside the handheld power tool. The accelerations can especially be rotational accelerations or a change in the rotational speed around the working axis of the handheld power tool. The signal strength of the measured signal is ascertained in a frequency band around a frequency that is equal to the product of the rotational speed of the wheel on the drive side and the number of blocking elements. The filter selects accelerations and vibrations that are associated with the slip clutch on the basis of their periodic occurrence. The power consumption of the handheld power tool is reduced if the signal strength in the frequency band exceeds a threshold value. The slipping of the slip clutch gives the user feedback in the usual manner that the present torque has exceeded a set limit. The subsequent automatic reduction of the motor output increases the service life of the slip clutch.

The handheld power tool can measure the rotational speed of the wheel on the drive side and can adapt the frequency band to the measured rotational speed.

BRIEF DESCRIPTION OF THE DRAWING

The description below explains the invention on the basis of embodiments and FIGURE provided by way of example. The FIGURE show the following:

FIG. 1: a hammer drill.

Unless otherwise indicated, the same or functionally identical elements are designated in the FIGURE by the same reference numerals.

DETAILED DESCRIPTION

FIG. 1 schematically shows a hammer drill 1 as an example of a chiseling handheld power tool. The hammer drill 1 has a tool socket 2 into which a shank end 3 of a tool, for example, a drill bit 4, can be inserted. The primary drive of the hammer drill 1 is in the form of a motor 5 that drives a striking mechanism 6 and a driven shaft 7. A battery pack 8 or a mains line supplies the motor 5 with power. The user can guide the hammer drill 1 by means of a handle 9 and can start up the hammer drill 1 by means of a system switch 10. During operation, the hammer drill 1 continuously rotates the drill bit 4 around the working axis 11 and, in this process, it can cause the drill bit 4 to strike into a substrate in the striking direction 12 along the working axis 11.

The striking mechanism 6 is a pneumatic striking mechanism 6. An exciter piston 13 and a striker 14 are installed movably along the working axis 11 in a guide tube 15 in the striking mechanism 6. The exciter piston 13 is coupled to the motor 5 via an eccentric 16 and it is forced to execute a periodical, linear movement. A connecting link 17 connects the eccentric 16 to the exciter piston 13. A pneumatic spring that is formed by a pneumatic chamber 18 between the exciter piston 13 and the striker 14 couples a movement of the striker 14 to the movement of the exciter piston 13. The striker 14 can strike a rear end of the drill bit 4 directly, or it can transfer some of its momentum to the drill bit 4 indirectly via an essentially stationary intermediate striker 19. The striking mechanism 6 and preferably the additional drive components are arranged inside a tool housing 20.

The driven shaft 7 is coupled to the motor 5 by means of a mechanical slip clutch 21. The slip clutch 21 given by way of an example has a bevel gear 22 that rotates around the working axis 11. A bevel gear 23 that is driven by the motor 5 meshes with the bevel gear 22 of the slip clutch 21. The bevel gear 22 is coupled to a rotary disk 25 via blocking elements 24. The rotary disk 25 is mounted so as to be rotatable around the same axis as the bevel gear 23, in this case the working axis 11. The rotary disk 25 can be moved along the working axis 11. In a first position, the rotary disk 25 is so close to the bevel gear 23 that the blocking elements 24 engage with the bevel gear 22 as well as with the rotary disk 25. The torque of the bevel gear 22 is transmitted to the rotary disk 25. The rotary disk 25 can move away from the bevel gear 22 along the working axis 11 into a second position to such an extent that the blocking elements 24 no longer engage with the rotary disk 25. The slip clutch 21 is opened. A spring 26 counters the deflection of the rotary disk 25 out of the first position. The blocking elements 24 are, for instance, balls that can be captured in pockets in the bevel gear 22 and that can engage with the rotary disk 25 in pockets. The slip clutch 21 is closed when the balls are engaged with the pockets and it transmits a torque. The slip clutch shown is given by way of an example. In an alternative slip clutch, the rotary disk can be situated inside the bevel gear, and the blocking elements are spring-loaded so that they can be moved in the radial direction.

The hammer drill 1 reduces the torque when the slip clutch 21 is triggered, for instance, because the drill bit 4 is jammed in the substrate. The hammer drill 1 has a sensor 27 that detects vibrations occurring in the tool housing. The sensor 27 can especially be a gyro sensor that detects rotational movements around an axis parallel to the working axis 11. Different accelerations occur during operation of the hammer drill 1, for example, due to the striking mechanism 6 and the rotating motor 5. During the transition from the open position into the closed position, the slip clutch 21 generates a jolt in the drive train owing to the coupling of the drill bit 4 to the motor 5. The jolt as a single event is not very specific and depends, for example, on the size of the drill bit 4 and on the material of the substrate. As long as the drill bit 4 is still jammed, the slip clutch 21 opens and closes periodically. The time span between two closing procedures is determined by the rotational speed of the driving bevel gear 22 and by the angle by which the bevel gear 23 has to be rotated until the blocking elements 24 can latch once again. This angle is inversely proportional to the number of blocking elements 24. The measured signal 28 of the sensor 27 is fed to a band-pass filter 29. The characteristics of the band-pass filter 29 are harmonized with the slip clutch 21. The center frequency of the band-pass filter 29 is preferably equal to the product of the rotational speed of the driving bevel gear 22 and the number of blocking elements 24. The number of blocking elements 24 is stored as a fixed quantity in the evaluation unit 30. Due to the fixed speed reduction ratio, the rotational speed of the bevel gear 22 is known to be proportional to the motor speed, which is detected by means of a sensor or which is queried from the appertaining speed regulator 31 in the case of a speed-regulated motor 5. The triggering frequency of the slip clutch 21 can be lower than the calculated frequency since the drive spindle continues to rotate owing to its angular momentum. As a rule, however, the angular momentum decreases rapidly, especially in case of a load on the drill bit 4. The frequency band is within the range from 75% to 150% of the calculated center frequency.

The evaluation unit 30 emits an error signal 32 when the filtered measured signal 33 exceeds a limit value. The error signal 32 is relayed to the motor control unit 31 which, in response, then reduces the rotational speed of the motor 5. The rotational speed is preferably reduced until the filtered measured signal 33 falls below the limit value. In a preferred embodiment, the motor control unit 31 only reduces the rotational speed once the limit value has been exceeded for a prescribed time span, for instance, at least 2 seconds. The user notices the triggering of the slip clutch 21 and, in this manner, receives clear-cut feedback as to why the motor output was reduced or set to zero.

The band-pass filter 29 preferably has an adjustable center frequency. The band-pass filter 29 detects the rotational speed of the bevel gear 22 and adapts the center frequency in advance. The band-pass filter 29 is preferably configured as a digital filter, for example, in the form of a software routine in a signal processor. The signal processor can ascertain the signal strength in several frequency bands in parallel. The evaluation unit 30 receives the signal strength of the frequency band whose center frequency comes closest to the product of the number of blocking elements 24 and the rotational speed.

What is claimed is:

1. A handheld power tool comprising:

a tool socket to hold a tool along a working axis;

a motor;

a slip clutch having a drive side wheel on a drive side and a driven side wheel on a driven side as well as a number (N) of blocking elements arranged between the drive side wheel and the driven side wheel, the blocking elements movable relative to one wheel of the drive side and driven side wheels and the blocking elements held engaged with the one wheel by a spring force, in order to transmit a torque from the drive side wheel to the driven side wheel and in order to interrupt the transmission of torque when a torque exceeding a threshold value is present;

a sensor serving to record a measured signal indicating movements of the handheld power tool;

a band-pass filter having a pass range, a product of the rotational speed of the drive side wheel and the number (N) of blocking elements lying within the pass range, an evaluation unit, the measured signal filtered by the band-pass filter being fed to the evaluation unit, the evaluation unit reducing a rotational speed of the motor in response to the filtered measured signal exceeding a limit value.

2. The handheld power tool as recited in claim 1 wherein the sensor is a gyro sensor serving to detect the measured signal as a measure of rotational movements around the working axis.

3. The handheld power tool as recited in claim 1 wherein the evaluation unit emits an error signal when the filtered measured signal exceeds the limit value.

4. The handheld power tool as recited in claim 1 wherein the band-pass filter has an adjustable center frequency calculated as the product of the rotational speed of the drive side wheel and the number (N) of blocking elements.

5. The handheld power tool as recited in claim 1 wherein the pass range includes 75% to 150% of the calculated center frequency.

6. The handheld power tool as recited in claim 1 wherein the drive side wheel is a bevel gear.

7. The handheld power tool as recited in claim 6 wherein the driven side wheel is a rotary disk.

8. The handheld power tool as recited in claim 7 wherein the blocking elements are balls between the bevel gear and the rotary disk.

9. The handheld power tool as recited in claim 1 wherein the sensor is a gyro sensor.

10. The handheld power tool as recited in claim 1 wherein the driven side wheel is a rotary disk.

11. The handheld power tool as recited in claim 1 wherein the power tool is a hammer drill and further comprises an exciter piston and a striker movable along the working axis in a guide tube.

12. The handheld power tool as recited in claim 11 further comprising an eccentric connecting the exciter piston to the motor.

13. The handheld power tool as recited in claim 12 further comprising a connecting link connecting the eccentric to the exciter piston.

14. The handheld power tool as recited in claim 11 further comprising a pneumatic chamber between the exciter piston and the striker.

* * * * *